US009950845B2

(12) United States Patent
Hsieh

(10) Patent No.: US 9,950,845 B2
(45) Date of Patent: Apr. 24, 2018

(54) CONTAINER THAT PREVENTS FROM AN ILLEGAL OPERATION AND CAN BE EASILY IDENTIFIED AFTER BEING ILLEGALLY OPERATED

(71) Applicant: Albert Hsieh, Lukang Township, Changhua County (TW)

(72) Inventor: Albert Hsieh, Lukang Township, Changhua County (TW)

(73) Assignee: VIGOURPLASTIC CO., LTD., Lukang Township, Changhua County (TW)

( * ) Notice: Subject to any disclaimer, the term of this patent is extended or adjusted under 35 U.S.C. 154(b) by 78 days.

(21) Appl. No.: 15/148,566

(22) Filed: May 6, 2016

(65) Prior Publication Data

US 2017/0107031 A1 Apr. 20, 2017

(30) Foreign Application Priority Data

Oct. 15, 2015 (TW) ..... 104133819 A

(51) Int. Cl.
*B65D 43/26* (2006.01)
*B65D 55/02* (2006.01)
*B65D 43/14* (2006.01)

(52) U.S. Cl.
CPC ..... *B65D 55/024* (2013.01); *B65D 43/14* (2013.01); *B65D 43/26* (2013.01); *B65D 2543/00333* (2013.01); *B65D 2543/00833* (2013.01)

(58) Field of Classification Search
CPC ..... B65D 55/024; B65D 43/14; B65D 43/26; B65D 2543/00833; B65D 2543/00333
USPC ..... 220/270
See application file for complete search history.

(56) References Cited

U.S. PATENT DOCUMENTS

2010/0051620 A1* 3/2010 Parikh ..... B65D 43/021 220/270
2015/0028033 A1* 1/2015 Samuel ..... B65D 43/0266 220/270

* cited by examiner

*Primary Examiner* — James N Smalley
(74) *Attorney, Agent, or Firm* — Egbert Law Offices, PLLC

(57) ABSTRACT

A container includes a casing having an opening and a first abutting edge surrounding the opening. A cover is selectively mounted onto the casing for closing the opening, wherein the cover has a second abutting edge laterally extending therefrom and abutting against the first abutting edge when the cover closes the opening. A puller extends from the second abutting edge of the cover. A snapping device is formed between the casing and the puller. The snapping device includes a plug formed on the puller and a socket defined in the casing for temporarily receiving the plug and holding the plug in place. A weakened portion is formed on at least one place of the puller such that the puller is irreversibly curved after being lifted due to the weakened portion and the curved puller is used as a basis for easily identifying whether the container is illegally operated or not.

5 Claims, 7 Drawing Sheets

CONTAINER THAT PREVENTS FROM AN ILLEGAL OPERATION AND CAN BE EASILY IDENTIFIED AFTER BEING ILLEGALLY OPERATED

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to container, and more particularly to a container that prevents from an illegal operation and can be easily identified after being illegally operated.

2. Description of Related Art Including Information Disclosed Under 37 CFR 1.97 and 37 CFR 1.98

Vacuum-formed plastic containers are usually made to have a box-shaped or a cup-shaped containing structure and used in the supermarkets for keeping food fresh. The plastic container is transparent for buyer to clearly see the contents, such as jelly-like, fruit or liquid foods and provided to stimulate customer's purchase intent. For containing liquid foods, the conventional plastic containers focus on the function of water-tightly seal. The conventional plastic container usually includes a hollow body and a body for selectively closing the hollow body.

For preventing the container from an illegal operation before checkout, some businesses position the cover of the container by staples. However, the casing or the cover of the container may be broken due to the staples when the buyer forcedly opening the cover. As a result, the container cannot be reused.

In addition, some businesses provided a snapper for temporarily positioning the cover on the casing of the container and a puller extending from cover for upwardly lifting the cover. As a result, the snapper is maintained in a cavity when the puller is lifted for opening the cover and a pre-broken line, formed on the puller is broken. However, the conventional plastic container is transparent and the cover is flexible such that the cover may be reinstated. Consequently, the manager and the checkout staff is difficultly to identify whether the container A is illegally operated or not. The altered plastic container cannot effectively prevent from an illegal operation and cannot be easily identified after being illegally operated.

The present invention has arisen to mitigate and/or obviate the disadvantages of the conventional plastic container.

BRIEF SUMMARY OF THE INVENTION

The main objective of the present invention is to provide an improved container that prevents from an illegal operation and can be easily identified after being illegally operated.

To achieve the objective, the container in accordance with the present invention comprises a casing including an opening and a first abutting edge surrounding the opening. A cover is selectively mounted onto the casing for closing the opening, wherein the cover has a second abutting edge laterally extending therefrom and abutting against the first abutting edge when the cover closes the opening. A puller extends from the second abutting edge of the cover. A snapping device is formed between the casing and the puller. The snapping device includes a plug formed on the puller and a socket defined in the casing for temporarily receiving the plug and holding the plug in place. A pre-broken line is formed on the puller and surrounds a root of the plug, wherein the plug is maintained in the socket when the pre-broken line is broken and the cover is lifted from the casing. A weakened portion is formed on at least one place of the puller such that the puller is irreversibly curved after being lifted due to the weakened portion and the curved puller is used as a basis for easily identifying whether the container is illegally operated or not.

Further benefits and advantages of the present invention will become apparent after a careful reading of the detailed description with appropriate reference to the accompanying drawings.

DETAILED DESCRIPTION OF THE INVENTION

Figure 6:
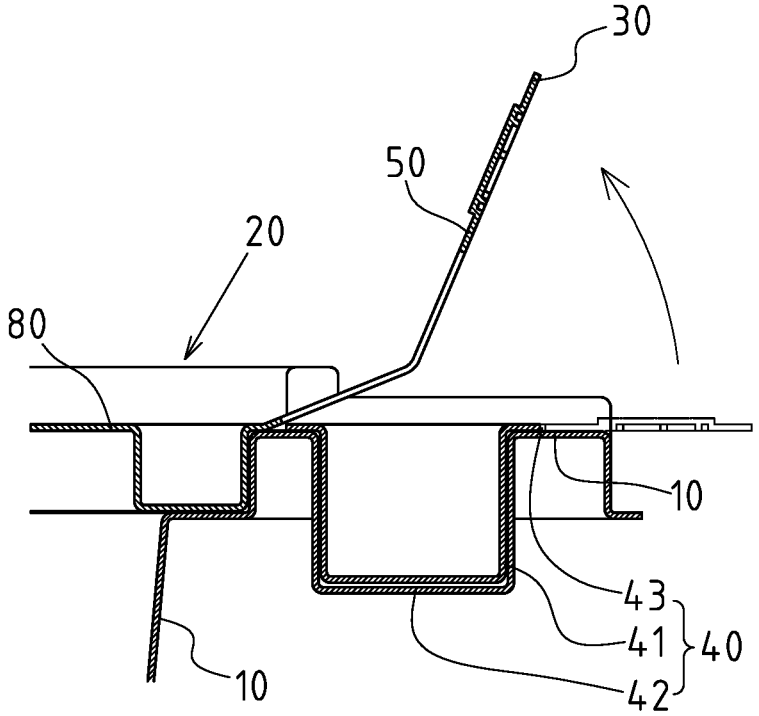
FIG. 6 is an operational view of the puller of the container in accordance with the present invention.

Referring to the drawings and initially to FIGS. 1-5, a container A that prevents from an illegal operation and can be easily identified after being illegally operated in accordance with the present invention comprises a casing 10 including an opening 12 and a first abutting edge 11 surrounding the opening 12. A cover 20 is selectively mounted onto the casing 10 for closing the opening 12, wherein the cover 20 has a second abutting edge 22 laterally extending therefrom and abutting against the first abutting edge 11 when the cover 20 closes the opening 12. A puller 30 extends from the second abutting edge 22 of the cover 20. In the preferred embodiment of the present invention, the puller 30 extends from one of multiple corners of the cover 20. A snapping device 40 is formed between the casing 10 and the puller 30. The snapping device 40 includes a plug 41 formed on the puller 30, a socket 42 defined in the casing 10 for temporarily receiving the plug 41 and holding the plug 41 in place. A pre-broken line 43 is formed on the puller 30 and surrounds a root of the plug 41, wherein the plug 41 is maintained in the socket 42 when the pre-broken line 43 is broken and the cover 20 is lifted from the casing 10. A weakened portion 50 is formed on at least one place of the puller 30 such that the puller 30 is irreversibly curved after being lifted due to the weakened portion 50 and the curved puller 30 is used as a basis for easily identifying whether the container A is illegally operated or not, as shown in FIGS. 6 and 7.

With reference to FIGS. 1 to 4, the pre-broken line 43 is separated from a periphery of the plug 41 and the weakened portion 50 is formed between the pre-broken line 43 and the opposite sides of the puller 30.

Figure 7:
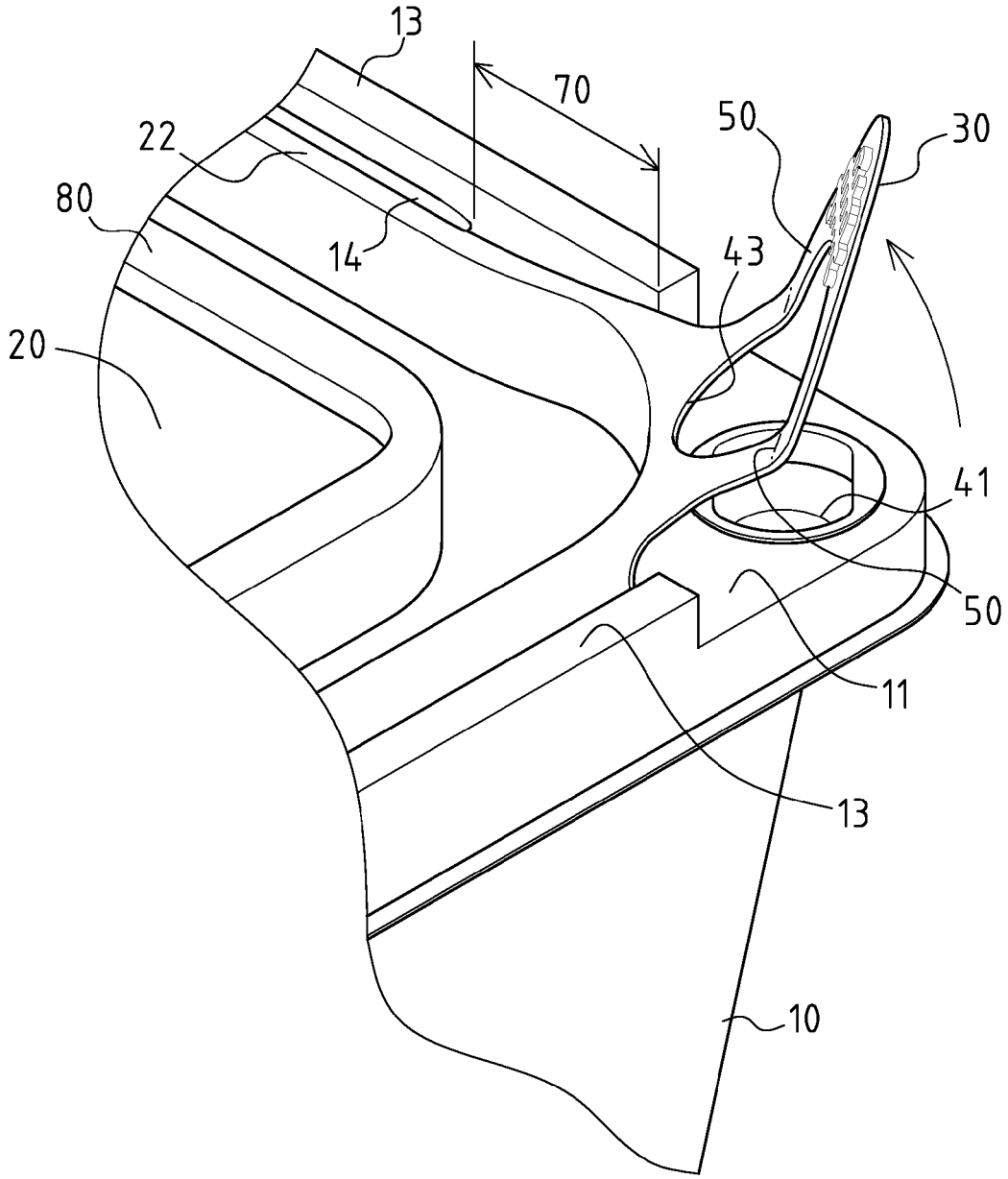
FIG. 7 is a perspective operational view of the puller of the container in accordance with the present invention.

With reference to FIG. 7, the pre-broken line 43, surrounding the plug 41, is broken, the puller 30 forms a pull-tab and the puller 30 is curved along the weakened portion 50 when the puller 30 is lifted.

Figure 10:
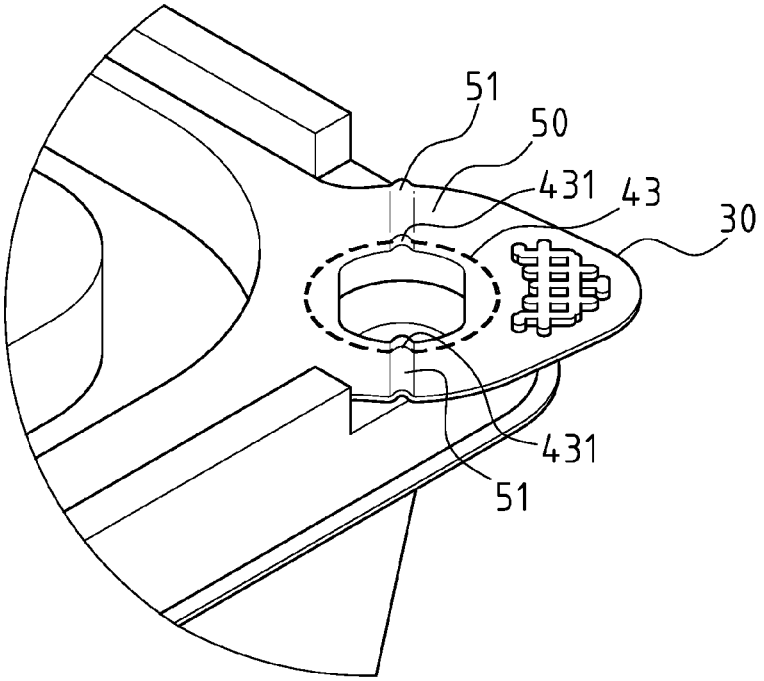
FIG. 10 is a perspective view of a second embodiment of the weakened portion of the container in accordance with the present invention.
Figure 11:
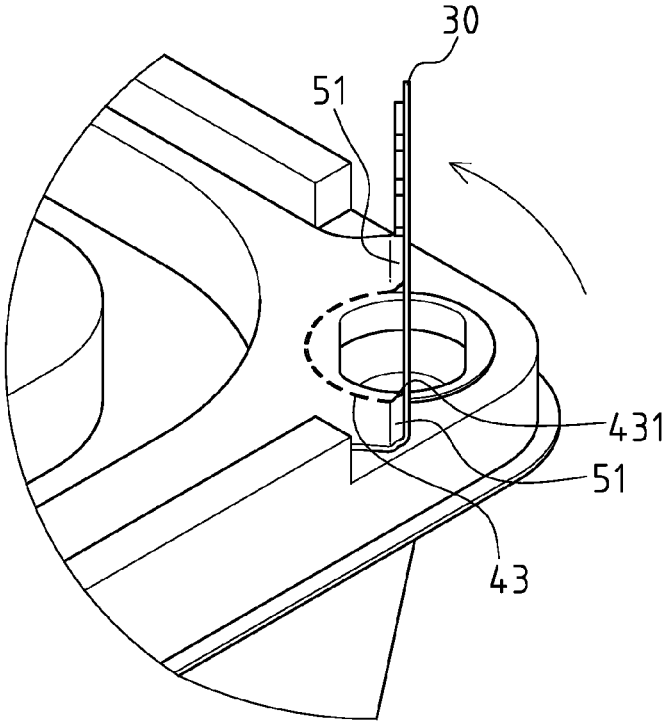
FIG. 11 is an operational view of the weakened portion in FIG. 10.

With reference to FIG. 10, the weakened portion 50 is formed with a fold edge 51 and the pre-broken line 43 has multiple connecting sections 431, wherein the fold edge 51 aligns with a corresponding one of the connecting sections 431 of the pre-broken line 43. In the preferred embodiment of the present invention, the fold edge 51 provides a greater resistance during lifting the puller 30 such that the operator more hardly forces the puller 30 and the puller 30 is more clearly curved, as shown in FIG. 11.

Figure 1:
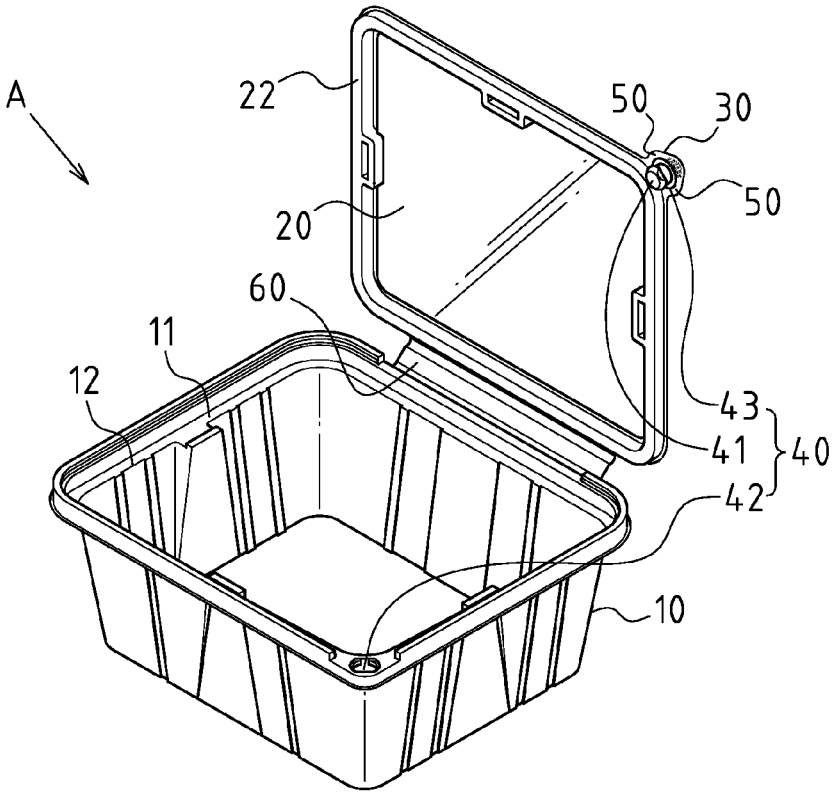
FIG. 1 is an opened perspective view of a container that prevents from an illegal operation and can be easily identified after being illegally operated in accordance with the present invention.
Figure 2:
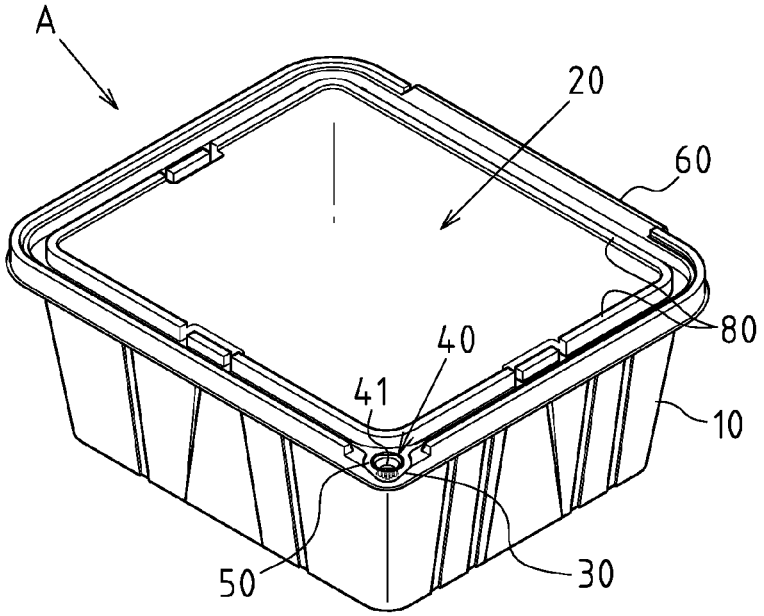
FIG. 2 is a closed perspective view of the container in accordance with the present invention.
Figure 3:
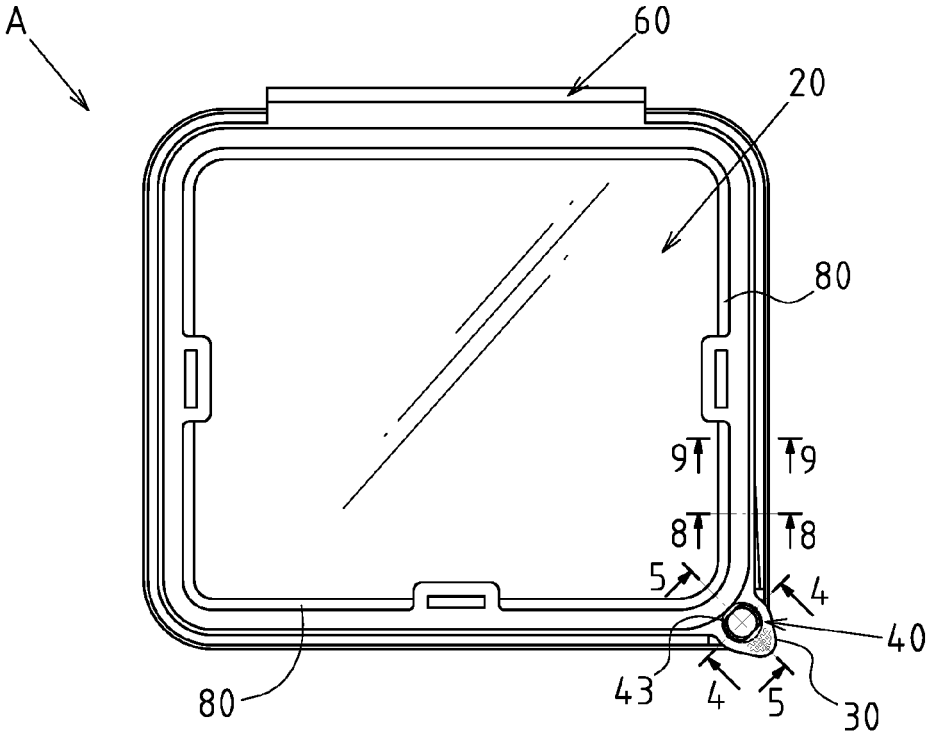
FIG. 3 is a top plan view of the container in accordance with the present invention.
Figure 4:
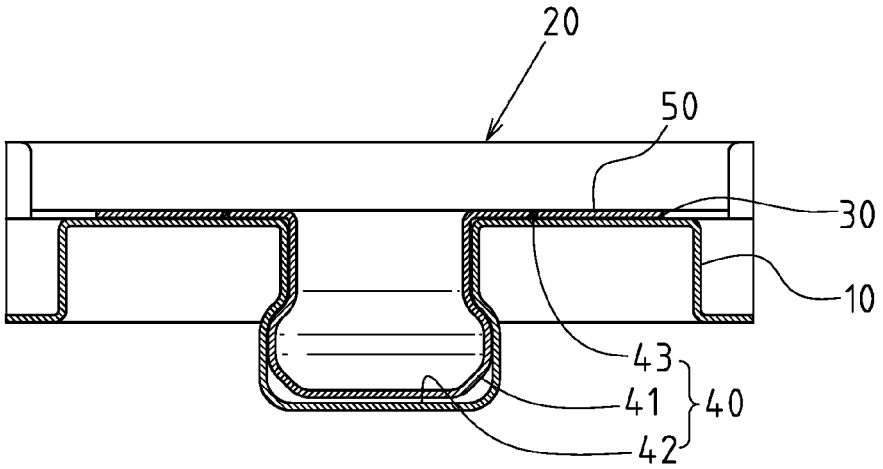
FIG. 4 is a partially cross-sectional view of the container in accordance with the present invention along line 4-4 in FIG. 3.
Figure 5:
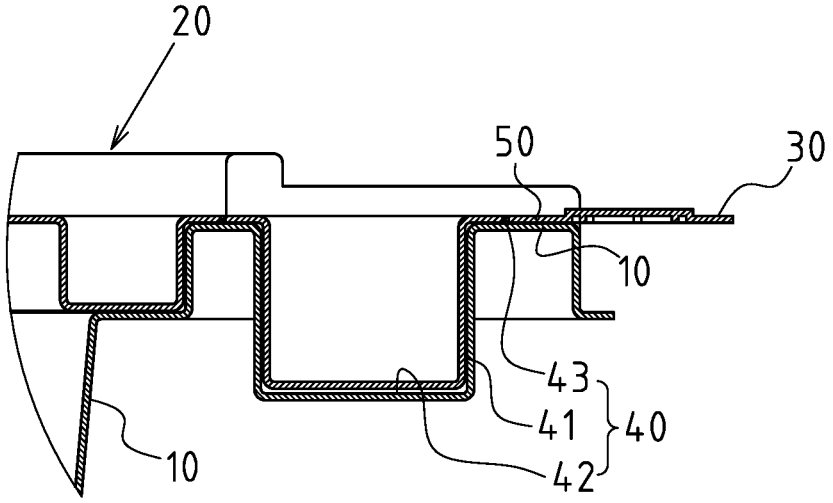
FIG. 5 is a cross-sectional view of the container in accordance with the present invention along line 5-5 in FIG. 3.

With reference to FIG. 1, at least one connecting plate 60 is provided to connect two corresponding sides of the cover 20 and the casing 10 such that the cover 20 is upward and inclined relative to the casing 10 after being lifted from the opening 12 in the casing 10. However, the connecting plate 60 is not absolutely necessary to the container A in accordance with the present invention.

Figure 8:
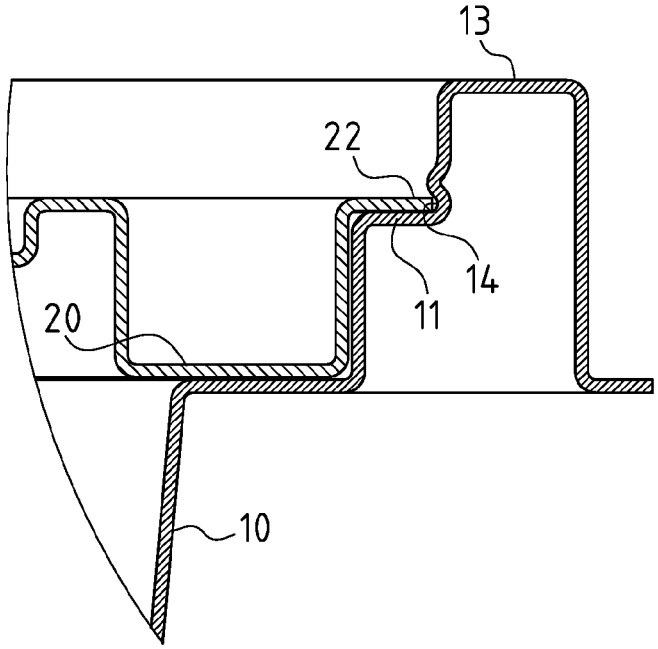
FIG. 8 is a cross-sectional view of the container in accordance with the present invention along line 8-8 in FIG. 3.
Figure 9:
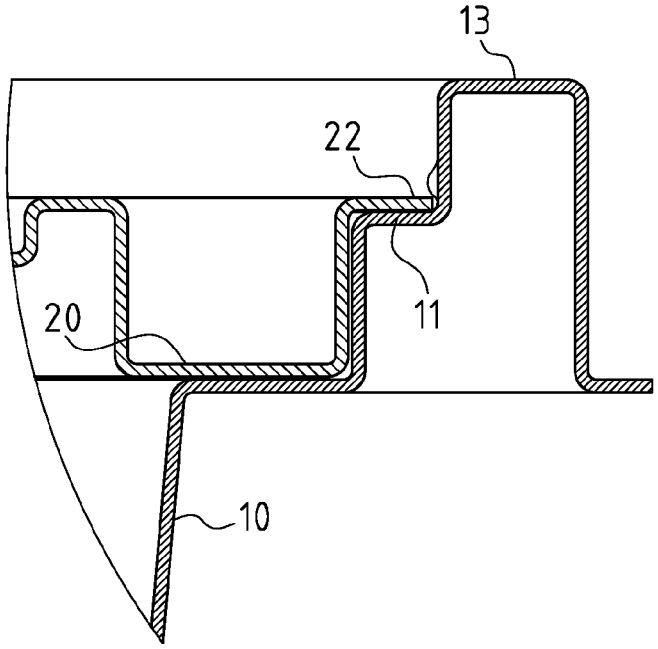
FIG. 9 is a cross-sectional view of the container in accordance with the present invention along line 9-9 in FIG. 3.

With reference to FIG. 8, the first abutting edge 11 is formed with a first wall 13, wherein an outer periphery of the second abutting edge 22 of the cover 20 is laterally engaged to the first wall 13. A groove 14 is laterally defined in a root of the first wall 13 and the outer periphery of the second abutting edge 22 of the cover 20 is laterally engaged into the groove 14. In the preferred embodiment of the present invention, the first wall 13 is provided to prevent an outer periphery of the first abutting edge 11 from an illegal dig relative to a fingernail.

With reference to FIG. 7, the groove 14 has two opposite ends and a free section 70 is formed between the snapping device 40 and each of the two opposite ends of the groove 14. The sides of the cover 20 are moved along the free section 70 when the puller 30 is upwardly lifted. As a result, the deforming area of the cover 20, after being lifted, is expanded for easily identifying after being illegally operated.

Figure 12:
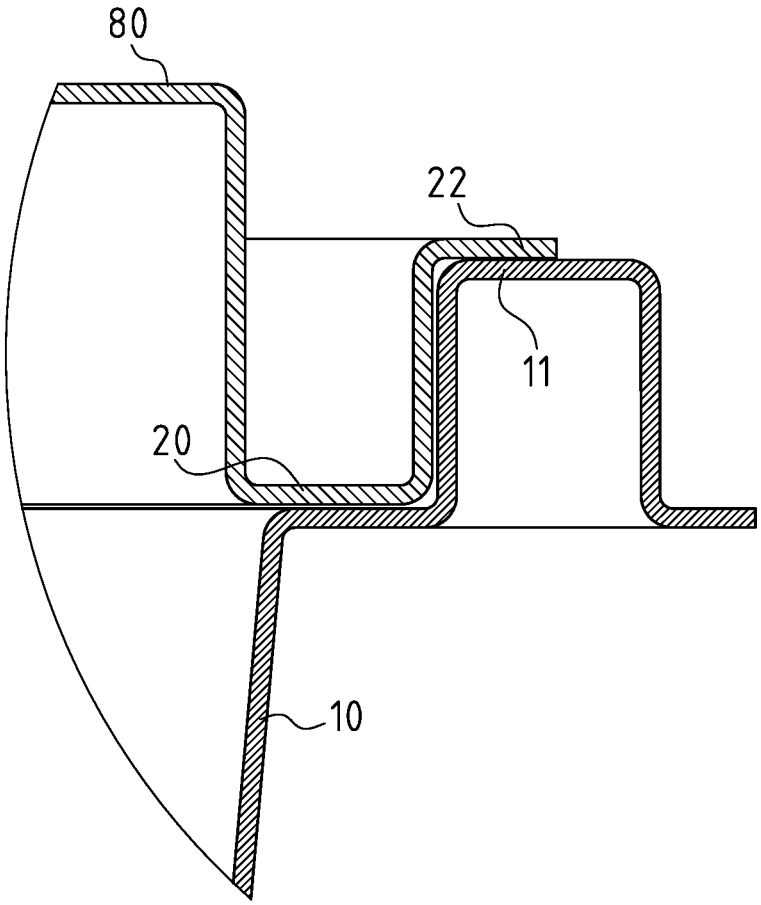
FIG. 12 is a partially cross-sectional view of a second embodiment of the cover of the container in accordance with the present invention.

With reference to FIG. 12, a second wall 80 is form on the cover 20 along the second abutting edge 22 for prevent the abutted first abutting edge 11 and the second abutting edge 22 from being detached from each other by pinching with one's fingers because the fingers touch the second wall 80 during pinching.

As described above, the manager and the checkout staff can easily identify whether the container A is illegally operated or not due to the curved puller 30 that is deformed when being pulled relative to the weakened portion 50. Consequently, the effect of preventing the container in accordance with the present invention from an illegally operation is promoted.

Although the invention has been explained in relation to its preferred embodiment, it is to be understood that many other possible modifications and variations can be made without departing from the spirit and scope of the invention as hereinafter claimed.

I claim:

1. A container that prevents tampering and allows the tampering to be easily identified after being tapered with, the container comprising:

a casing having an opening and a first abutting edge surrounding the opening;

a cover selectively mounted onto the casing for closing the opening, wherein the cover has a second abutting edge laterally extending therefrom and abutting against the first abutting edge when the cover closes the opening;

a puller extending from the second abutting edge of the cover;

a snapping device formed between the casing and the puller, the snapping device having a plug formed on the puller and a socket defined in the casing for temporarily receiving the plug and holding the plug in place, wherein a pre-broken line is formed on the puller and surrounds a root of the plug, wherein the plug is maintained in the socket when the pre-broken line is broken and the cover is lifted from the casing; and a weakened portion formed on at least one place of the puller such that the puller is irreversibly curved after being lifted due to the weakened portion and the puller is used to easily identify whether the container is tampered with, wherein the pre-broken line is separated from a periphery of the plug and the weakened portion is formed between the pre-broken line and opposite sides of the puller, wherein the puller forms a pull-tab and the puller is curved along the weakened portion when the puller is lifted and when the pre-broken line which surrounds the plug is broken, wherein the weakened portion is formed with a fold edge and the pre-broken line has multiple connecting sections, the fold edge aligning with a corresponding one of the multiple connecting sections of the pre-broken line.

2. The container of claim 1, further comprising:

at least one connecting plate connecting two corresponding sides of the cover and the casing such that the cover extends upwardly and inclined relative to the casing after being lifted from the opening in the casing.

3. The container of claim 2, wherein the first abutting edge is formed with a first wall and an outer periphery of the second abutting edge of the cover is laterally engaged to the first wall, wherein a groove is laterally defined in a root of the first wall and the outer periphery of the second abutting edge of the cover is laterally engaged into the groove.

4. The container of claim 3, wherein the groove has two opposite ends and a free section is formed between the snapping device and each of the two opposite ends of the groove, wherein the sides of the cover are moveable along the free section when the puller is upwardly lifted.

5. The container of claim 4, wherein a second wall is formed on the cover along the second abutting edge for preventing the first abutting edge and the second abutting edge from being detached from each other by pinching with fingers.

* * * * *